US011105532B2

(12) United States Patent
Kachelhoffer et al.

(10) Patent No.: US 11,105,532 B2
(45) Date of Patent: Aug. 31, 2021

(54) ELECTRIC HEATING DEVICE AND METHOD FOR ITS MANUFACTURE

(71) Applicant: Eberspächer catem GmbH & Co. KG, Herxheim (DE)

(72) Inventors: Patrick Kachelhoffer, Seebach (FR); Kurt Walz, Hagenbach (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 0 days.

(21) Appl. No.: 16/945,031

(22) Filed: Jul. 31, 2020

(65) Prior Publication Data

US 2021/0033303 A1 Feb. 4, 2021

(30) Foreign Application Priority Data

Aug. 1, 2019 (DE) ..... 102019211565.9
Aug. 1, 2019 (DE) ..... 102019211569.1

(51) Int. Cl.
*F24H 3/04* (2006.01)
*H05B 1/02* (2006.01)

(52) U.S. Cl.
CPC ..... *F24H 3/0476* (2013.01); *F24H 3/0441* (2013.01); *F24H 3/0464* (2013.01); *H05B 1/023* (2013.01); *H05B 2203/02* (2013.01)

(58) Field of Classification Search
CPC .... F24H 3/0476; F24H 3/0464; F24H 3/0441; H05B 1/023; H05B 2203/02;
(Continued)

(56) References Cited

U.S. PATENT DOCUMENTS 8,637,796 B2 1/2014 Bohlender
8,946,599 B2 2/2015 Niederer et al.
(Continued)

FOREIGN PATENT DOCUMENTS

CN 109028554 12/2018
EP 2637474 9/2013

OTHER PUBLICATIONS

EP 1 872 986 A1, US 2008/0000889 A1.
(Continued)

*Primary Examiner* — Shawntina T Fuqua
(74) *Attorney, Agent, or Firm* — Boyle Fredrickson S.C.

(57) ABSTRACT

An electric heating includes a housing having a partition wall which separates a connection chamber from a heating chamber for dissipating heat and from which at least one receiving pocket, protruding into the heating chamber as a heating rib, preferably tapering towards its lower and closed end, protrudes. A PTC heating element, including at least one PTC element and conductor tracks for energizing the PTC element with different polarities, is accommodated in the housing with the conductor tracks being electrically conductively connected to the PTC heating element and being are electrically connected in the connection chamber. A pressure element is received in the housing and holds heat extraction surfaces of the PTC element abutted against oppositely disposed inner surfaces of the receiving pocket. To reduce mechanical stress on the PTC element or an insulating layer and, while at the same time retaining the PTC heating element in the receiving pocket, at least one web acts in a positive-fit and/or force-fit manner on the pressure element.

25 Claims, 13 Drawing Sheets

(58) Field of Classification Search
CPC ..... H05B 2203/023; H05B 2203/017; H05B 3/06; H05B 3/10
See application file for complete search history.

(56) References Cited

U.S. PATENT DOCUMENTS

| | | | | |
|---|---|---|---|---|
| 2008/0000889 | A1 | 1/2008 | Niederer et al. | |
| 2008/0099464 | A1* | 5/2008 | Niederer ..... | H05B 3/24 219/520 |
| 2011/0147370 | A1 | 6/2011 | Bohlender | |
| 2013/0233845 | A1 | 9/2013 | Bohlender et al. | |
| 2016/0360572 | A1 | 12/2016 | Bohlender et al. | |
| 2016/0360573 | A1 | 12/2016 | Bohlender et al. | |

OTHER PUBLICATIONS

EP 2 237 425 A1, US 2011/0147370 A1.
EP 2 637 747 A1, US 2013/0233845 A1.
EP 3 101 365 A1, US 2016/0360573 A1 US 2016/0360572 A1.

* cited by examiner

ELECTRIC HEATING DEVICE AND METHOD FOR ITS MANUFACTURE

BACKGROUND OF THE INVENTION

1. Field of the Invention

The present invention relates to an electric heating device with a housing having a partition wall which separates a connection chamber from a heating chamber for dissipating heat. At least one receiving pocket protruding into the heating chamber as a heating rib protrudes from the partition wall. A PTC heating element is provided in this pocket. Furthermore, a pressure element is accommodated in the pocket and holds heat extraction surfaces of the PTC element abutted against opposite inner surfaces of the receiving pocket.

2. Background of the Invention

The PTC heating element has at least one PTC element and conductor tracks abutting thereagainst in an electrically conductive manner. The conductor tracks are connected to the PTC element in an electrically conductively manner. This connection can be a positive-fit and/or force-fit and/or positive substance-fit connection.

The aforementioned general features of the electric heating device apply to the prior art according to EP 1 872 986 A1. They also apply to the implementation of the invention.

The earlier proposals EP 2 637 474 A1 and EP 2 337 425 A1, respectively, originating from the applicant each disclose PTC heating elements which are introduced into a previously mentioned receiving pocket.

EP 2 337 425 A1 discloses a solution in which a conductor track abutting against a main side surface of the PTC element is provided as a piece of sheet metal with contact projections bent out of the plane of the piece of sheet metal. The contact projections only serve to improve the electric contact of the PTC element.

In the previously known solutions described above, the receiving pocket tapers towards its lower closed end. Accordingly, the insertion opening that opens to the connection chamber is wider than the lower closed end of the receiving pocket. The PTC elements and the contact plates abutting thereto on both sides are typically braced with a wedge-shaped pressure element, with the interposition of at least one insulating layer between the conductor tracks and oppositely disposed inner surface of the receiving pocket, into the latter. This wedge element ensures that the layers of the layer structure are abutted in a clamped manner against one another. These layers are at least the PTC elements and the conductor tracks extending at right angles to the direction of force action of the wedge element, usually contact plates, and at least one insulating layer.

Despite the production-related cross-sectional shape of the receiving pocket tapering downwardly, the wedge element is to enable good heat transfer, preferably between the two mutually opposite heat extraction surfaces of the PTC element and the respective inner surfaces of the receiving pocket associated therewith with the interposition of the pressure element. Due to the pressure built up there, the oppositely disposed heat extraction surface of the PTC element is abutted directly or with the interposition of an insulating layer against the oppositely disposed inner surface of the receiving pocket.

CN 109028554 A discloses an electric heating device with the features of the pre-amble of claim 1. In this prior art, the PTC heating element is accommodated in a pocket-shaped pressure element which has mutually oppositely disposed side sections which are connected to each other via a base section. The pocket-shaped pressure element is wedge-shaped in cross-section in order to enable uniform heat-conducting abutment of the pressure element against the inner surfaces of a receiving pocket tapering towards its lower end facing away from the connection chamber.

The previously presented prior art solutions each ensure good heat extraction. However, there is the problem that the receiving pocket does not always correspond to the designed shape due to manufacturing tolerances. Because, for production reasons, the PTC elements are subject to considerable dimensional fluctuations. It is also not always ensured that the heat extraction surfaces of the PTC element run completely straight and planar.

Pressing in a wedge as a pressure element can lead to stress peaks, due to which the PTC element or a ceramic insulating layer can break inside the receiving pocket. Depending on the tolerances, the wedge element used as a pressure element in prior art in the specific application might not be thick enough, so that it basically sits uselessly at the lower end of the receiving pocket. If, on the other hand, the free space remaining before the wedge element is introduced is too small, then this results in insufficient coverage of the heat extraction surface of the PTC element in the height direction of the receiving pocket, i.e. between the lower end and the insertion opening. As a result, the PTC element heats up too much and prevents further uptake of power current. Consequently, the degree of efficiency of the PTC element is poor.

SUMMARY

The present invention seeks to provide a solution that remedies all or some of these issues. The electric heating device includes a housing having a partition wall which separates a connection chamber from a heating chamber for dissipating heat and from which at least one receiving pocket, protruding into the heating chamber as a heating rib, preferably tapering towards its lower and closed end, protrudes. A PTC heating element, including at least one PTC element and conductor tracks for energizing the PTC element with different polarities is accommodated in the housing with the conductor tracks being electrically conductively connected to the PTC heating element and which are electrically connected in the connection chamber. A pressure element is received in the housing and holds heat extraction surfaces of the PTC element abutted against oppositely disposed inner surfaces of the receiving pocket. At least one web acts in a positive-fit and/or force-fit manner on the pressure element to retain the pressure element in the receiving pocket. The web is therefore a device securing the position of the pressure element in the receiving pocket. The web causes the position to be retained by direct or indirect positive-fit and/or force-fit interaction with the pressure element. In the installed state, the web typically bridges a space or gap and keeps the latter clear in part. This space or gap extends between the outer, typically free end of the web and its end on the attachment side.

The web can be provided in the receiving pocket and/or in the connection chamber. A web provided in the connection chamber is in particular a holding web which interacts with one end of a layer within the receiving pocket. Such a layer can be the pressure element and/or the PTC element and/or at least one of the conductor tracks and/or a heater housing accommodating at least one of these layers. Such a layer can also be formed by an insulating layer which is accommodated in the receiving pocket and is provided between at least one heat extraction surface of the PTC element and the associated inner surface of the receiving pocket in order to avoid electrical contact of this inner surface with the corresponding heat extraction surface. The holding web can be connected, for example, to a cover element which covers the connection chamber as a lid and typically seals it from the environment. The holding web can me made of rubber-elastic material or at least have a region formed from such a rubber-elastic material. Such rubber-elastic material can be, for example, an elastomer. The holding web can project through the connection chamber in a column-like manner and can abut with its free end against the free end of at least one of the layers or the heater housing, respectively. The free end of the holding web can entirely or in part engage around a free end of the layer. The holding web can also be used, for example, to secure an electrical connection between a connection cable and one of the conductor tracks. The holding web can, for example, engage around elements of a plug connection and/or a crimp connection for the electrical connection of the PTC heating element to a cable or abut thereagainst. Resilient deformation of the holding piece can also follow any degree of compression setting during the operation of the electric heating device, provided the holding web interacts with the functional element under resilient preload An alternative embodiment of a web acting in the form of a positive-fit or force-fit connection is formed by a deformation projection which is held in the receiving pocket under resilient deformation. In this embodiment, as well, the respective deformation projection bridges a gap between the inner surface of the receiving pocket and the associated heat extraction surface of the PTC element. This gap can be pressed free directly adjacent to the inner surface in the receiving pocket and can be penetrated by the deformation projection. The web may abut against the inner surface of the receiving pocket. However, the gap can also extend between an insulating layer abutting against the inner surface and the contact plate.

The deformation projection is resiliently deformed in the installed state. The deformability of the deformation projection may be selected such that it can absorb and store local stress peaks by resilient deformation which are due to or caused by an uneven abutment surface within the receiving pocket, for example, an uneven inner surface. Several deformation projections are typically arranged distributed in a planar manner over the heat extraction surface. On the one hand, this results in a planar resilient preload force, by which the individual contact surfaces between the layers accommodated in the receiving pocket are abutted against one another. The deformation projections thus maintain the clamping effect caused by the pressure element and store the clamping force resiliently in the manner of spring segments. The planar distribution of the deformation projections applies this resilient preload force to the heat extraction surfaces of the PTC element in a planar manner, so that good and permanent heat extraction is ensured.

The webs, and in particular the deformation projections, are generally of a discrete design. For example, individual webs are provided at a distance from one another and may be arranged distributed in a planar manner over the heat extraction surface. The discrete arrangement of the deformation projections allows for the local deformation of each one of the webs depending on the contour and unevenness of the associated inner surface of the pocket. In this way, stress peaks are absorbed locally as best as possible. This effectively prevents, for example, a ceramic insulating layer received in the receiving pocket from fracturing.

The deformation projections press free a gap that can be between 0.1 and 4 millimeters wide. This gap can be filled with thermally conductive material engulfing the projection deformations to ensure the best possible heat transfer from the heat extraction surface of the PTC element to the associated inner surface of the receiving pocket.

In view of a simple preload of the deformation projections when the pressure element is introduced into the receiving pocket, it is preferable to form the deformation projections in the direction toward the inlet opening of the receiving pocket obliquely relative to the heat extraction surface and inclined toward the connection chamber. This configuration facilitates the insertion of the deformation projections, since each deformation projection pivots about its end on the attachment side as it contacts the inner surface when introduced into the receiving pocket, so that the free end is abutted in a resilient manner against the inner surface of the receiving pocket.

Although resilient preload forces for the force-fit retention of the position of the pressure element in the receiving pocket are already very effective, it is proposed in accordance with a preferred development of the invention to design the deformation projection with a tip that claws into the inner surface of the receiving pocket thus providing a positive-fit retention. This tip locks with the inner surface. It acts like a barb, so that the layers provided in the receiving chamber cannot be pushed out of the receiving pocket or migrate out from the receiving pocket against their direction of insertion and due to vibrations of the vehicle.

According to a preferred development of the present invention, the web is attached to the pressure element, and may be formed integrally thereon. This provides the possibility of inserting the web together with the pressure element into the receiving pocket, so that the bracing caused by the pressure element is at the same time stored in the web as a resilient clamping. In addition, the parts to be handled during the assembly of the electric heating device are reduced due to the prior connection of the web and the pressure element, which simplifies the assembly.

The integrally formed configuration of the pressure element together with the at least one web may be formed by a piece of sheet metal from which the webs are formed integrally by punching and bending. The free ends of the shaped webs can be cut or bent accordingly to form a barb. The piece of sheet metal can also form the conductor tracks as a contact plate. In this case, the piece of sheet metal is typically provided with connection lugs which are regularly formed integrally on the piece of sheet metal and are used to electrically connect the PTC heating element to the power current.

The integral formation of the pressure element together with the at least one web may be done in an extruded section. This extruded section is first worked out as an extrusion and cut to length such that the pressure element completely or at least predominantly covers the heat extraction surface of the PTC element. This does not necessarily mean that the pressure element abuts directly against the heat extraction surface. A sliding plate substantially covering the heat extraction surface can instead be provided in a manner known per se between the pressure element and the associated heat extraction surface of the PTC element. This sliding plate protects the PTC element from damage when the pressure element is inserted. The sliding plate can be abutted against the PTC element with the interposition of the conductor track. An insulating layer can also be provided between the sliding plate and a contact plate which may forms the conductor tracks.

The contact plate typically forms integrally formed contact strips that are exposed in the connection chamber for the electrical connection of the PTC heating element.

According to a further preferred embodiment of the present invention, at least one web is respectively provided between each of the heat extraction surfaces and the associated inner surface of the pocket. The layers provided in the pocket are held resiliently under preload with respect to the PTC element from two opposite sides.

According to a preferred development of the present invention, a pocket-shaped pressure element is provided which accommodates the PTC element and at least one of the conductor tracks and is provided with at least one of the webs on at least one of its outer surfaces that is provided adjoining the heat extraction surfaces. At least one respective web is typically provided on opposite outer surfaces of the pocket-shaped pressure element. The planar distribution of the webs over both outer surfaces of the pocket-shaped pressure element is particularly preferred.

In particular in the case of a wedge-like cross-sectional shape of the receiving pocket, it is preferable to design the pressure element itself having a wedge shape. In addition or alternatively, deformation projections distributed in a planar manner can be formed such that the deformation projections provided at the lower end of the receiving pocket protrude less far and are accordingly shorter in a direction transverse to the heat extraction surface than the deformation projections provided at the upper end of the receiving pocket. In a cross-sectional view of the receiving pocket filled with the layers, a straight line approximated to the free ends of the webs arises and extends obliquely relative to the associated heat extraction surface. This straight line can form an angle of less than 10° with the heat extraction surface. The angle is typically between 2° and 8°. Elements of the PTC heating element, i.e. at least the PTC element and the conductor tracks abutting thereagainst, that are configured with plane-parallel main side surfaces can be used, since an adaptation to the possible conical cross-sectional shape of the receiving pocket takes place due to the individual configuration of the deformation projections which follow the contour and the alignment of the inner surface and in the vertical direction of the pocket abut, possibly in a preloaded manner with approximately the same resilient force.

Provided in the receiving pocket are preferably at least two PTC elements between which at least one deformation projection is provided. These two PTC elements are provided substantially at the same height in the receiving pocket and are abutted under resilient preload against one another and on the opposite side against the inner surface of the receiving pocket by the at least one deformation projection, usually by a plurality of deformation projections. The receiving pocket can form the ground of an energization to the two PTC elements, whereas the several deformation projections between the PTC elements are assigned to the other polarity and may be provided formed integrally with a connection strip which is exposed in the connection chamber.

The partition wall of the electric heating device according to the present invention can be formed integrally with the receiving pocket. This embodiment lends itself to an electric heating device in which a housing lower part defines a circulation chamber into which the receiving pocket protrudes in the manner of a heating rib and forms the inlet and outlet openings for the flow of a medium to be heated in the heating chamber, where the corresponding housing part is produced by way of extrusion or die-casting aluminum. In this respect, the preferred embodiment of the electric heating device according to the invention corresponds to the embodiment described in EP 1 872 986 A1. The same applies to the electrical connection of the conductor tracks in the connection chamber which is provided on the side of the partition wall opposite the circulation chamber and typically electrically connects several PTC heating elements via a printed circuit board and/or via a control unit provided in the connection chamber to the PTC heating elements enables actuating individual or all PTC heating elements of the electric heating device. For this purpose, the conductor tracks typically have connection lugs which on their free portion project over the receiving pocket and are exposed in the connection chamber. The conductor tracks can be formed in a manner known per se by contact plates which form the connection lug at their free end.

The pressure element as such can be formed from spring-rigid material, where a material should be selected that also exhibits good thermal conductivity. For example, spring-rigid aluminum, copper or brass is preferable to steel sheet due to the improved thermal conductivity. The pressure element can be formed to be wedge-shaped in cross section and can be combined with a piece of metal sheet that forms the deformation projections.

According to a preferred development of the present invention, a heater housing made of insulating material is provided and joins the PTC element and the conductor tracks to form a unit and guides the pressure element in a slidable manner. Such a heater housing typically consists of insulating material, such as plastic material or ceramic material. For guiding the pressure element, the heater housing has a sliding guide which extends substantially in the vertical direction. The heater housing can be adhesively bonded to one or both conductor tracks. It is also possible to injection-mold-coat the conductor tracks with the interposition of the PTC element(s) during the injection molding process of manufacturing the heater housing from plastic material. This creates one entity. The sliding guide typically has mutually oppositely disposed guide slots in which the pressure element and/or an edge region of a piece of sheet metal forming the deformation projections is slidably guided. The heater housing can also accommodate the possibly present at least one insulating layer and position it relative to the contact plate. The heater housing can also have a sliding plate provided between the heat extraction surface of the PTC element and the pressure element in order to obtain further uniformity of the contact pressure which is caused by the individual spring segments. However, the present invention may do without such a sliding plate, since the configuration of the spring segments and the thickness of the sheet metal strip are selected such that the rather punctiform pressure load caused by each individual deformation projection remains subcritical, so that mechanical damage to the PTC element and/or other layers of the layer structure, in particular the insulating layer, is not to be feared.

The aforementioned thermally conductive material may be a thermally high-conductive mass. The thermal conductivity should be at least 3 W/(m K). The material should be introduced after the PTC heating element has been inserted into the receiving pocket and after the pressure element has been pushed in the vertical direction relative to the layers of the layer structure and for bracing the same in the receiving pocket when the PTC heating element is positioned relatively in the receiving pocket In other words, the PTC heating element is first introduced into the receiving pocket.

The pressure element is thereafter introduced into the receiving pocket or, if the pressure element has already been introduced with the PTC heating element into the receiving pocket, is displaced relative to the layer structure in order to preload the layers of the PTC heating element. The pressure element has the wedge shape described above for this purpose as well, at least when the housing is manufactured by way of pressure die casting. Because a wedge-shaped receiving pocket can hardly be avoided with this method. However, the present invention can also be implemented with non-wedge-shaped receiving pockets. The spring segments can each be configured in such a way that they resemble a planar contact surface with their contact points or surfaces, or they abut against a contoured or randomly inclined surface, and trace the latter's contours via abutment points or surfaces formed by the individual spring segments.

Once the layers of the layer structure have been braced in the receiving pocket by the pressure element, the mass is filled into the pocket. This mass may fill all the free spaces in the pocket so that good heat transfer from the PTC element to all inner surfaces of the pocket arises, including the end faces thereof. The mechanical bracing is maintained by the spring segments of the pressure element. The mass may be a permanently elastic mass, so that a certain flexibility of the mass is also given and the spring segments can also follow certain compensatory motions during operation which arise, for example, due to the thermal expansion of the individual layers of the layer structure. A suitable mass is e.g. two-component silicone which can be filled with ceramic particles to improve thermal conductivity.

According to alternative variant, the pressure element has a web which interacts in a positive-fit or force-fit manner with the inner surface in order to permanently secure and hold the PTC heating element in the receiving pocket. The web, accordingly, causes the position to be secured by positive-fit and/or force-fit interaction directly or indirectly with the pressure element. In the installed state, the web typically bridges a space or gap and keeps the latter clear in part. This space or gap extends between the outer, typically free end of the web and its end on the attachment side.

This end on the attachment side can protrude from a sheet metal element which is connected to a base body that forms the receptacle of the pressure element. In this case, the pocket-shaped pressure element is configured to be multipart.

However, the web may be formed integrally on a uniformly designed pressure element.

As is known from prior art, the pressure element can have a wedge-like cross-sectional shape. This cross-sectional shape arises, for example, when connecting the outermost contour points of the pressure element. The wedge shape is formed in particular by the free ends of the webs, which protrude from one, and potentially from both side wall sections of the pressure element in the direction toward the associated inner surfaces of the receiving pocket.

Several webs may protrude from each of the side sections. The aforementioned wedge shape can be created in that, when a base body is designed having basically uniform wall thicknesses, the webs provided by the upper end of the receiving pocket near the connection chamber are longer than the webs provided at the lower end of the receiving pocket.

In the installed state, the webs are resiliently deformed. The deformability of the webs may be selected such that they can absorb and store local stress peaks by resilient deformation, which are due to or caused by an uneven abutment surface within the receiving pocket, for example, an uneven inner surface. Several webs are typically arranged distributed over the heat extraction surface. On the one hand, this results in a planar resilient preload force, by which the individual contact surfaces between the layers accommodated in the receiving pocket are abutted against one another. The webs thus maintain the clamping effect caused by the pressure element and store the clamping force in the manner of spring segments in a resilient manner. The planar distribution of the webs applies this resilient preload force to the heat extraction surfaces of the PTC element in a planar manner, so that good and permanent heat extraction is ensured.

The webs are usually formed to be discrete. For example, individual webs are provided at a distance from one another and are preferably arranged distributed in a planar manner over the heat extraction surface. The discrete arrangement of the webs allows for local deformation of each of the webs depending on the contour and unevenness of the associated inner surface of the pocket. In this way, stress peaks are absorbed locally as best as possible.

The webs may press free a gap that can be between 0.1 and 4 millimeters wide. This gap can be filled with thermally conductive material engulfing the webs to ensure the best possible heat transfer from the heat extraction surface of the PTC element to the associated inner surface of the receiving pocket.

In view of a simple preload of the webs when the pressure element is introduced into the receiving pocket, the web can be formed in the direction toward the inlet opening of the receiving pocket obliquely relative to the heat extraction surface and inclined toward the connection chamber. This configuration facilitates the insertion of the webs, since each web pivots about its end on the attachment side as it contacts the inner surface when introduced into the receiving pocket, so that the free end is abutted in a resilient manner against the inner surface of the receiving pocket.

Although resilient preload forces for the force-fit retainment of the position of the pressure element in the receiving pocket are already very effective, it is proposed in accordance with a preferred development of the invention to design the web with a tip that grips into the inner surface of the receiving pocket thus providing a positive-fit lock. This tip engages locks the inner surface. It acts like a barb, so that the layers provided in the receiving chamber cannot be pushed out of the receiving pocket or migrate out from the receiving pocket against their direction of insertion and due to vibrations of the vehicle. According to a preferred development of the present invention, the web is attached to the pressure element, particularly preferably formed integrally thereon. This provides the possibility of inserting the web together with the pressure element into the receiving pocket, so that the bracing caused by the pressure element is at the same time stored in the web as a resilient clamping. In addition, the parts to be handled during the assembly of the electric heating device are reduced due to the prior connection of the web and the pressure element, which simplifies the assembly.

One possibility for the positive-fit retainment of the PTC heating element in the receptacle is formed by a retaining web which at the upper end protrudes above the PTC heating element. This upper end is provided near the connection chamber. The retaining web typically protrudes over a flat boundary surface extending in a planar manner which is formed by the pressure element and typically extends parallel to the heat extraction surface. A single retaining web protruding from one of the side wall sections is sufficient for realizing the positive-fit accommodation of the PTC heating element in the pressure element. Retaining webs may be provided on oppositely disposed side wall sections. The retaining webs are typically located at the free end of the side wall sections.

The integrally formed pressure element together with the at least one web, possibly with the at least one retaining web, may be formed in an extruded section. This extruded section is first worked out as an extrusion and cut to length such that the pressure element completely or at least predominantly covers the heat extraction surface of the PTC element. This does not necessarily mean that the pressure element abuts directly against the heat extraction surface. An insulating layer substantially covering the heat extraction surface can instead be provided in a manner known per se between the pressure element and the associated heat extraction surface of the PTC element. The insulating layer accordingly insulates—typically electrically—the pressure element from a [sic] that forms the conductor track.

The contact plate typically forms integrally formed contact strips that are exposed in the connection chamber for the electrical connection of the PTC heating element. Insulating layers may be respectively provided between the contact plates that are each typically abutting against the heat extraction or heat coupling surfaces and the surfaces of the receptacle of the pressure element that extend parallel thereto. However, one of these insulating layers can just as well be dispensed with in order to connect the PTC element to ground via the pressure element and the inner surface of the receiving pocket. The housing of the electric heating device then forms the ground.

In a cross-sectional view of the receiving pocket filled with the layers, a straight line approximated to the free ends of the webs arises and extends obliquely relative to the associated heat extraction surface. This straight line can form an angle of less than 10° with the heat extraction surface. The angle is typically between 2° and 8°. Elements of the PTC heating element, i.e. at least the PTC element and the conductor tracks abutting against it, that are configured with plane-parallel main side surfaces can be used, since an adaptation to the possible conical cross-sectional shape of the receiving pocket takes place due to the individual configuration of the deformation projections which follow the contour and the alignment of the inner surface and in the height direction of the pocket abutting, possibly preloaded with approximately the same resilient force.

The partition wall of the electric heating device according to the present invention can be formed integrally with the receiving pocket. This embodiment lends itself to an electric heating device in which a housing lower part defines a circulation chamber into which the receiving pocket protrudes in the manner of a heating rib and forms the inlet and outlet openings for the flow of a medium to be heated in the heating chamber, where the corresponding housing part is produced by way of extrusion or die-casting aluminum. In this respect, the preferred embodiment of the electric heating device according to the invention corresponds to the embodiment described in EP 1 872 986 A1. The same applies to the electrical connection of the conductor tracks in the connection chamber which is provided on the side of the partition wall opposite the circulation chamber and typically electrically connects several PTC heating elements via a printed circuit board and/or via a control unit provided in the connection chamber to the PTC heating elements enables actuating individual or all PTC heating elements of the electric heating device. For this purpose, the conductor tracks typically have connection lugs which on their free portion project over the receiving pocket and are exposed in the connection chamber. The contact plates that may form the conductor tracks can form the connection lugs possibly integrally at their free end.

The pressure element as such can be formed from spring-rigid material, where a material should be selected that also exhibits good thermal conductivity. For example, spring-rigid aluminum, copper or brass is preferable to steel sheet due to the improved thermal conductivity.

According to a preferred development of the present invention, a heater housing made of insulating material is provided and joins the PTC element and the conductor tracks as well as at least one possibly provided insulating layer to form a unit. Such a heater housing typically consists of insulating material, such as plastic material or ceramic material, and is accommodated in the receptacle of the pressure element. The heater housing can be adhesively bonded to one or both conductor tracks. It is also possible to injection-mold-coat the conductor tracks with the interposition of the PTC element(s) during the injection molding process of manufacturing the heater housing from plastic material. This creates one entity. The aforementioned thermally conductive material may be a thermally high-conductive mass. The thermal conductivity should be at least 3 W/(m K). The material should be made [sic] after the PTC heating element has been inserted into the receiving pocket and after the pressure element has been pushed in the vertical direction relative to the layers of the layer structure and for bracing the same in the receiving pocket when the PTC heating element is positioned relatively in the receiving pocket In other words, the fitted pressure element is first introduced into the receiving pocket. The webs can each be configured in such a way that they resemble a planar contact surface with their contact points or surfaces, or they abut against a contoured or randomly inclined surface, and trace the latter's contours via abutment points or surfaces formed by the individual webs.

Once the fitted pressure element has been clamped in the receiving pocket, the mass is filled into the pocket. This mass may fill all the free spaces in the pocket so that good heat transfer from the PTC element to all inner surfaces of the pocket arises, including the end faces thereof. The mechanical bracing is maintained by the spring segments of the pressure element. The mass may be a permanently elastic mass, so that a certain flexibility of the mass is also given and the spring segments can also follow certain compensatory motions during operation which arise, for example, due to the thermal expansion of the individual layers of the layer structure. A suitable mass is e.g. two-component silicone which can be filled with ceramic particles to improve thermal conductivity.

BRIEF DESCRIPTION OF THE DRAWINGS

Further details and advantages of the present invention shall become apparent from the following description of an embodiment in combination with the drawing, in which.

DETAILED DESCRIPTION

Figure 1:
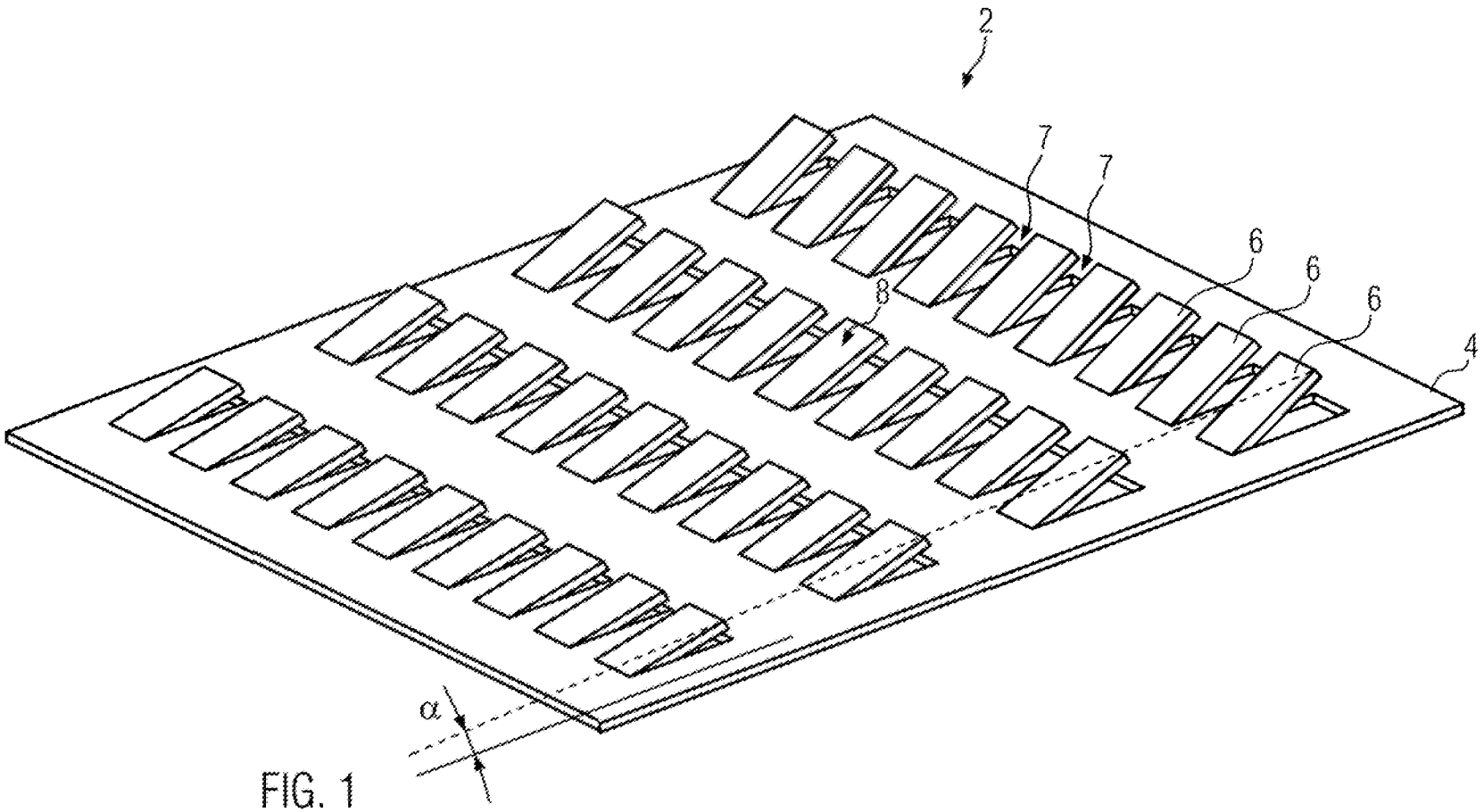
FIG. 1 shows a perspective top view of an embodiment of a pressure element according to an embodiment of the invention.

FIG. 1 shows an embodiment of a pressure element 2 according to the invention comprising a sheet metal strip identified with reference number 4 from which deformation elements 6 are worked out by punching and bending. The deformation elements 6 are formed by punching out lateral edges 7 and bending webs 8 resulting therefrom. The webs 8 are each connected with one of their two end sides to the base material of the sheet metal strip 4. A deformation projection 6 projecting from the sheet metal strip 4 with a relatively high spring rigidity is formed by each of the webs 8.

Figure 2:
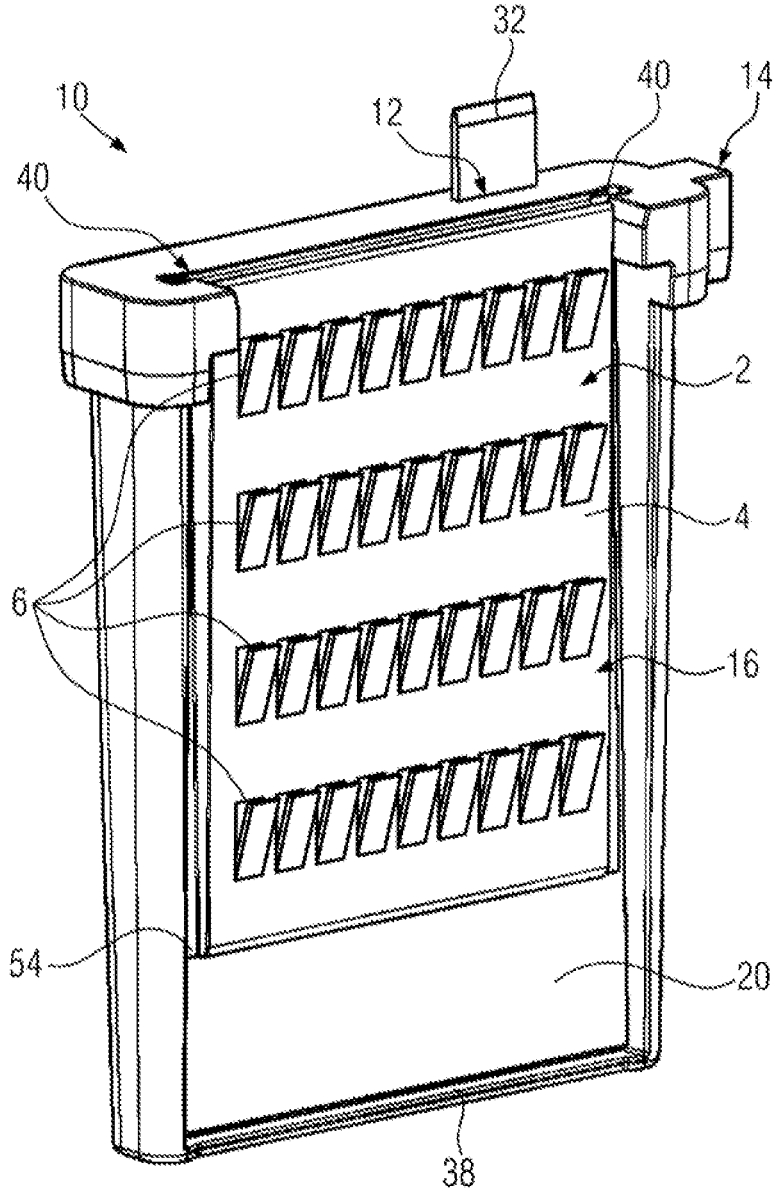
FIG. 2 shows a perspective side view of an embodiment of a heater housing with the pressure element according to FIG. 1.
Figure 3:
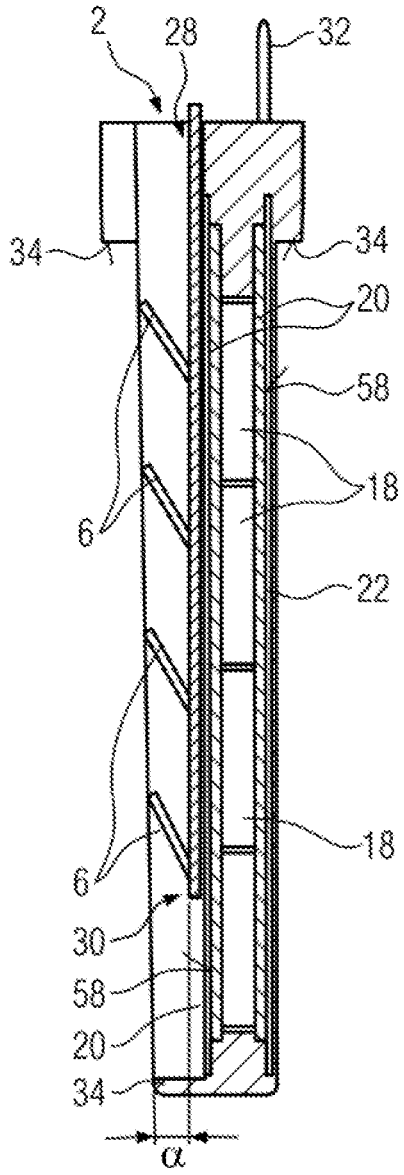
FIG. 3 shows a cross-sectional view of the embodiment shown in FIG. 2.

A straight line can be applied at the respective outer surface points of the individual deformation elements 6. The oppositely disposed lines connecting the sheet metal strip 4 forms an angle $\alpha$ of less than 10° with the plane of the sheet metal strip 4 (cf. FIG. 1). Details of the PTC heating element can be gathered from FIGS. 2 to 4. The PTC heating element is identified there with reference number 10 and has a heater housing 12 made of plastic material which is formed to be frame-shaped with an upper rim 14 projecting beyond the frame in the thickness direction and a frame opening 16 in which four PTC elements 18 are provided one above the other. As shown in FIG. 3, conductor tracks in the form of contact plates 20 abut in an electrically conductive manner against both sides of the PTC elements 18. The contact plates 20 are connected to the heater housing 12, for example, by adhesive bonding. On one side (the right one in FIG. 3), the contact plate 20 is covered with an insulating layer 22. This insulating layer can be a plastic film or a ceramic plate or a combination of a ceramic plate with a plastic film. The plastic film is typically located on the outer side of the ceramic plate, which has the advantage that the plastic film can compensate for a certain roughness on an inner surface of a receiving pocket and thus absorb stress peaks that could impair the ceramic layer. The receiving pocket is marked with reference number 24 in FIGS. 5 and 6, the inner surface with reference numeral 26 in FIG. 6.

On the side opposite the insulating layer 22, the contact plate 20 there forms the outer surface of the layer structure. The pressure element 2 already described in FIG. 1 is disposed adjoining this outer surface. FIGS. 2 and 3 show the pressure element 2 before the layer structure is braced in the receiving pocket 24. The pressure element 2 is in a raised position. The upper end 28 of the pressure element 2 is located in the region of the rim 14. The lower end of the pressure element 2, identified with reference numeral 30, is located at the medium height of the lower PTC element 18.

Figure 5:
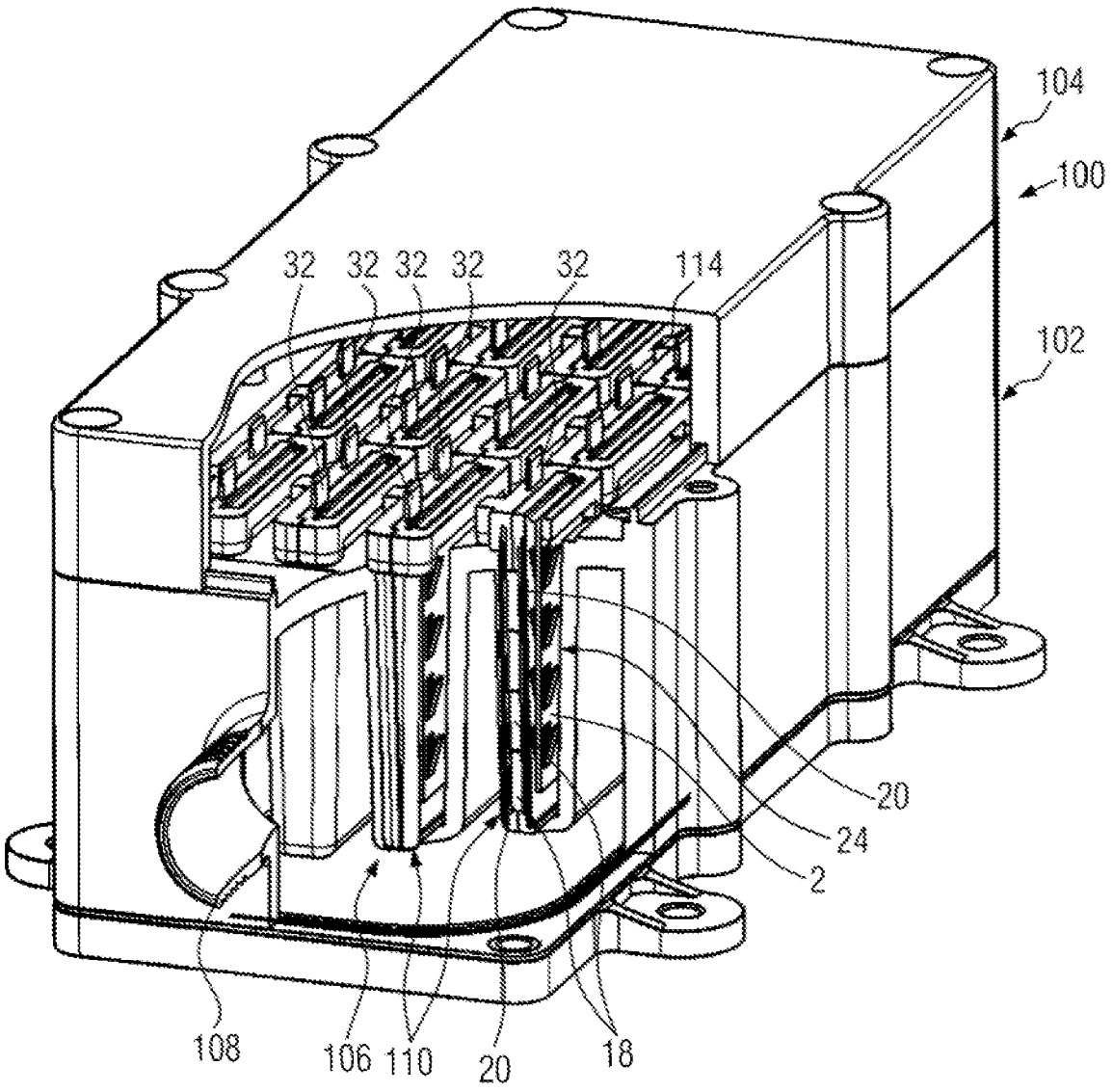
FIG. 5 shows a perspective face view of an embodiment of an electric heating device with the heater housing partially removed.

The assembly of the heater housing 12 and the pressure element 2 shall be explained below with reference to FIGS. 5 and 6. They show an embodiment of an electric heating device with a housing base 102 and a housing cover 104. The housing base 102 comprises a circulation chamber 106 which is connected via ports, of which only one port 108 is shown in FIG. 5, to a line for a liquid fluid to be heated. The electric heating device is, in particular, an electric heating device in a motor vehicle.

The circulation chamber 106 is penetrated by several heating ribs 110 extending in the longitudinal direction of the housing base 102 and in a cross-sectional view having a substantially U-like cross-sectional shape and are circumferentially enclosed with respect to the circulation chamber 106. These heating ribs 110 form the previously mentioned receiving pocket 24. In the embodiment shown, the electric heating device has adjacently disposed pockets which extend substantially over the entire length of the housing base 102. The receiving pockets 24 are considerably longer than the heater housing 12. In the longitudinal direction of the receiving pocket 24, several heater housings 12 fit one behind the other into the receiving pocket 24 (cf. FIG. 5).

The housing base 102 forms a partition wall 112, which separates the circulation chamber 106 from a connection chamber 114, in which connection strips are exposed which are electrically conductively connected to the contact plates 20, are presently formed integrally thereon. In the embodiment shown in FIGS. 5 and 6, two connection lugs 32 are provided for each PTC heating element 10 for energizing the PTC elements 18 with different polarities.

Figure 4:
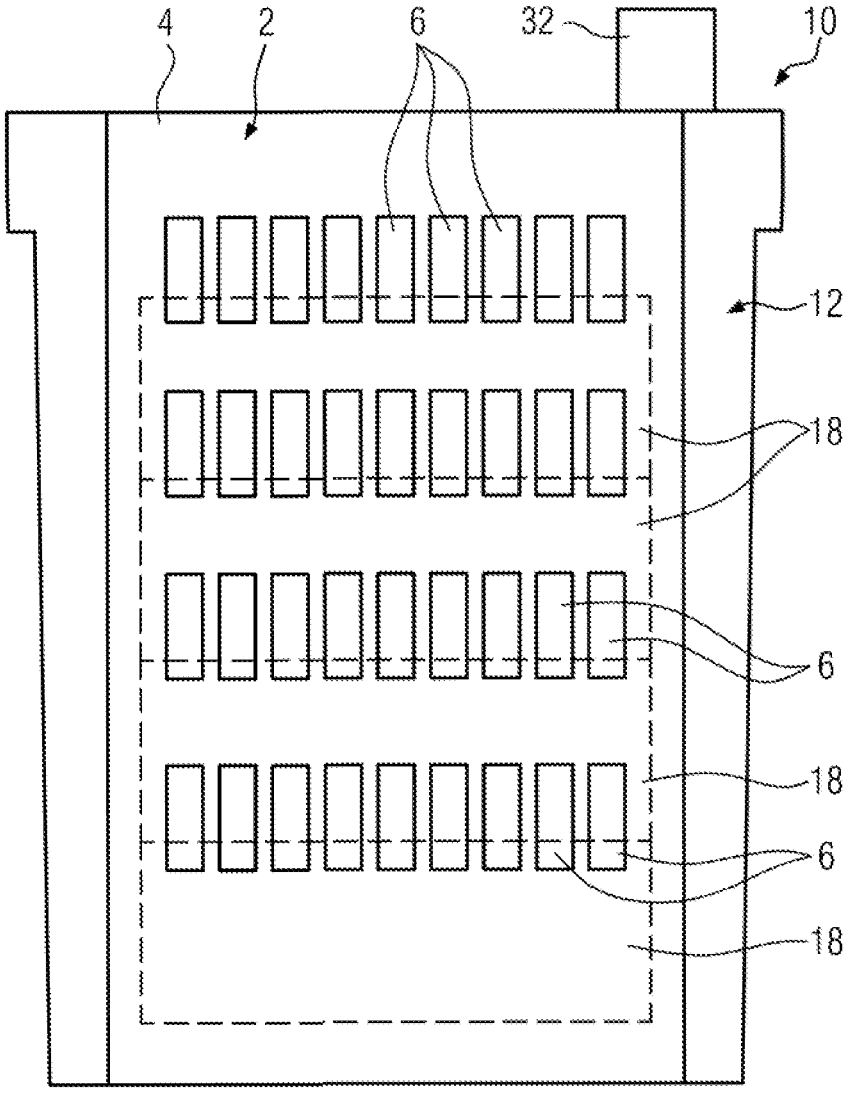
FIG. 4 shows a top view onto the embodiment shown in FIGS. 2 and 3.

The embodiment according to FIGS. 2 to 4 can be guided by the contemplation that the power current for energizing the PTC elements 18 drops to ground, which in the present case can be formed by the housing base 102, so that only one of the contact plates 20 needs to be connected to a connection lug 32, whereas the other polarity is given through the electrical connection of the housing base 102 to ground. The power current then flows over the inner surface 26 and through the pressure element 2.

Both connection options are conceivable.

For the assembly, the PTC heating element 10 is pushed into the receiving pocket 24 until a stop 34 formed by the rim 14 abuts against the upper side of the partition wall 112. As a result, the heater housing 12 and therefore the PTC heating element 10 is positioned relative to the housing 100. The insulating layer 22 is then disposed immediately adjacent to the corresponding inner surface 26. On the opposite side, the pressure element 2 is in its initial position between the inner surface 26 and the associated contact plate 20. The layers of the layer structure are not yet abutted against each other under preload.

The pressure element 2 is now pushed towards the lower end of the receiving pocket which is identified with reference numeral 36. The deformation segments 6 are resiliently preloaded with this relative motion of the pressure element 2. In the same way, the layers of the layer structure are abutted against one another and the insulating layer 22 against the associated inner surface 26 of the receiving pocket 24. The introduction of the pressure element 2 in this manner can be path-controlled or force-controlled. The force there is the degree of tension in the layers of the layer structure. After a certain preload force corresponding to an axial compressive force for introducing the pressure element 2 has been reached, the insertion motion of the pressure element 2 into the receiving pocket 24 can terminate.

Alternatively or in addition, a lower stop can be provided which defines the maximum insertion distance of the pressure element 2. Such a lower stop can be formed, for example, by a cross web formed at the lower end of the heater housing 12 and drawn in with reference numeral 38 in FIGS. 2 and 3. Alternatively, such a cross web 38 can be omitted, so that the insertion motion of the pressure element 2 is defined by the lower end 36 of the receiving pocket 24. The sheet metal strip 4 can equally well be provided wider than a sliding guide for the pressure element 2, identified with reference numeral 40, which is formed on the heater housing 12 and can be seen in FIG. 2. This widening on the upper side forms a stop which interacts with the rim 14 and defines the maximum insertion depth of the pressure element 2.

Figure 6:
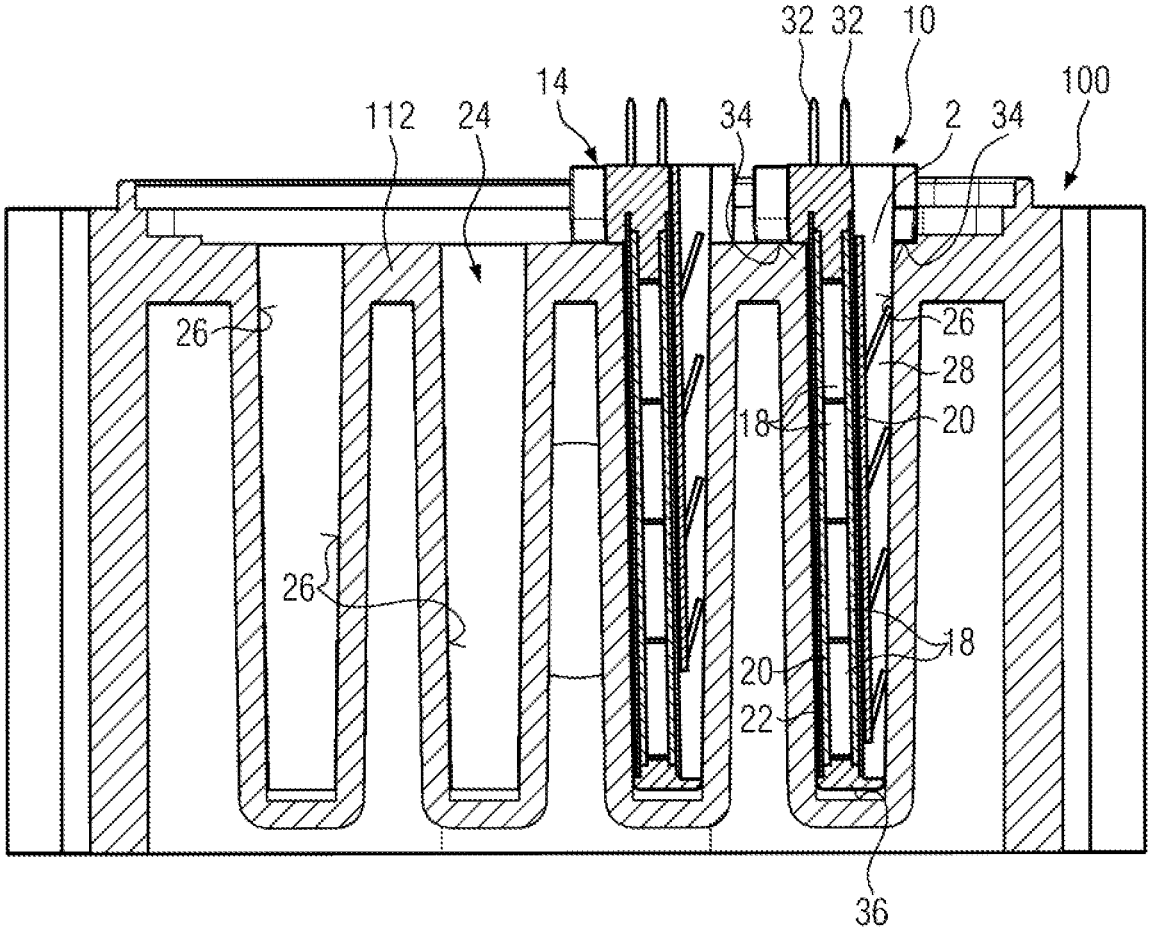
FIG. 6 shows a cross-sectional view of the embodiment shown in FIG. 5.

FIG. 6 shows the pressure element 2 in the receiving pocket 24 on the right-hand side after the introduction into the receiving pocket 24 and in the receiving pocket 24 provided on the left-hand side adjacent thereto prior to the introduction for bracing the elements of the layer structure. The deformation projections 6 have deformed resiliently as a result of the insertion and abut against the inner surface 26. The layers of the layer structure are abutted against each other. The layer structure is abutted in a planar manner on the side opposite the pressure element 2 against the inner surface 26 provided there. Pressing the pressure element 2 into the receiving pocket 24 can be carried out with a tool which on one face side has a groove that is adapted to receive the sheet metal strip 4 and that grips the sheet metal strip 4 at the end.

Thereafter, a preferably permanently elastic plastic mass, to which good heat-conductive but electrically non-conductive filler particles are added, for example, particles made of aluminum oxide, can be filled into the receiving pocket 24 in order to fill it entirely and to displace the air remaining therein. This results in good heat conduction between the elements of the layer structure and all surfaces defining the receiving pocket 24 on the inside.

Figure 7:
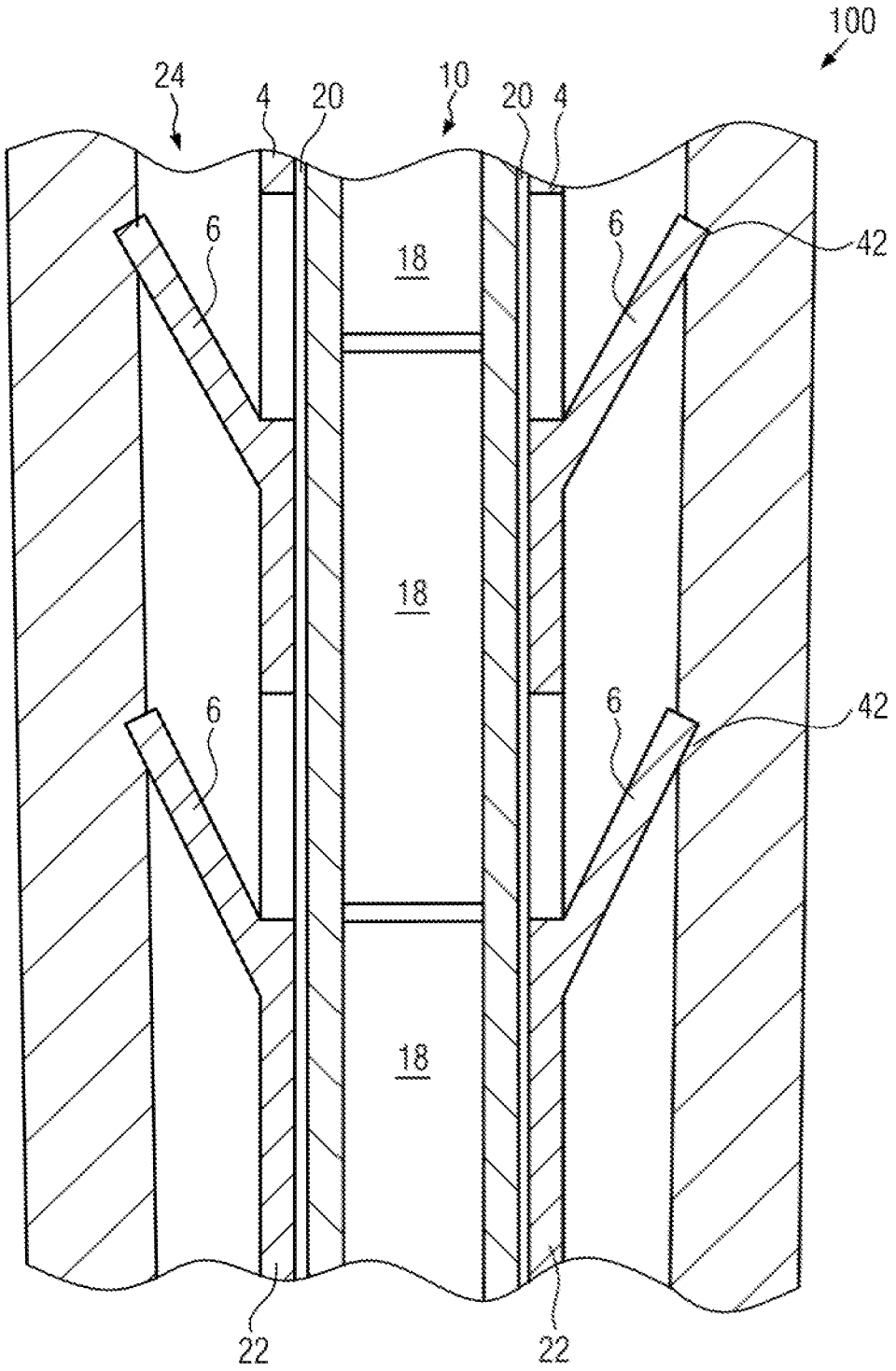
FIG. 7 shows the detail of FIG. 6 in an enlarged view.

FIG. 7 shows an enlarged detail of FIG. 6. As shown, the deformation projections 6 are provided by edges having a sharp-edged tip 42. The tip 42 acts like a barb that inhibits any movement in the opposite direction. The sheet metal strip can be firmly connected to the PTC heating element, for example, be adhesively bonded thereto. The deformation projections 6 are inclined in the direction toward the insertion opening of the receiving pocket 24 which is closed on the underside. When the sheet metal strip 4 is introduced, the deformation projections 6 are bent in the direction toward the sheet metal material of the sheet metal strip 4. The sheet metal strip 4 can optionally be introduced into the receiving pocket 24 together with other elements of the PTC heating element 10, while the deformation projections 6 are bent due to their inclination in the direction toward the planar sheet metal strip 4. In this way, the PTC heating element 10 can be introduced into the receiving pocket 24 while the deformation projections 6 scrape along the inner surface 26. In the installation position shown in FIG. 7, the tips 42 are clawed to the inner surface 26 of the receiving pocket 24 and are therefore connected in a positive-fit or force-fit manner, respectively.

To better retain the installation position of the PTC heating element 10 in the receiving pocket 24, the PTC element 18 can be adhesively bonded to the contact plates 20 and the sheet metal strips 4, optionally to further layers within the receiving pocket 24, such as an insulating layer 22.

In FIG. 7, the sheet metal strip 4 shown on the left-hand side abuts directly against the associated contact surface. The deformation projections 6 claw to the inner surface 26 of the receiving pocket 24. This results in electrical contact between the metallic housing 100 and the contact plates 20. The PTC element 18 is therefore connected to the ground on the left-hand side in FIG. 7, which is formed by the housing 100.

The insulating layer 22 is located on the right-hand side according to FIG. 7 between the sheet metal strip 4 and the contact plate 20. The contact plate 20 provided there is provided with a connection lug, not shown in FIG. 7, which projects beyond the opening of the receiving pocket 24 and is exposed in the connection chamber 114. In contrast, the extension of the contact plate 20 on the left-hand side is limited to the region of the receiving pocket 24.

Figure 8:
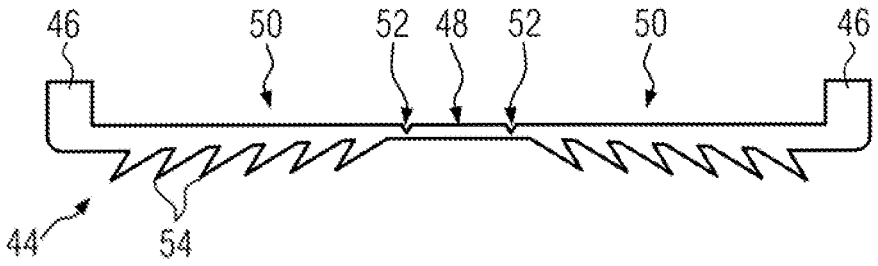
FIG. 8 shows a side view of an alternative embodiment of a heater housing for realizing the present invention.
Figure 9:
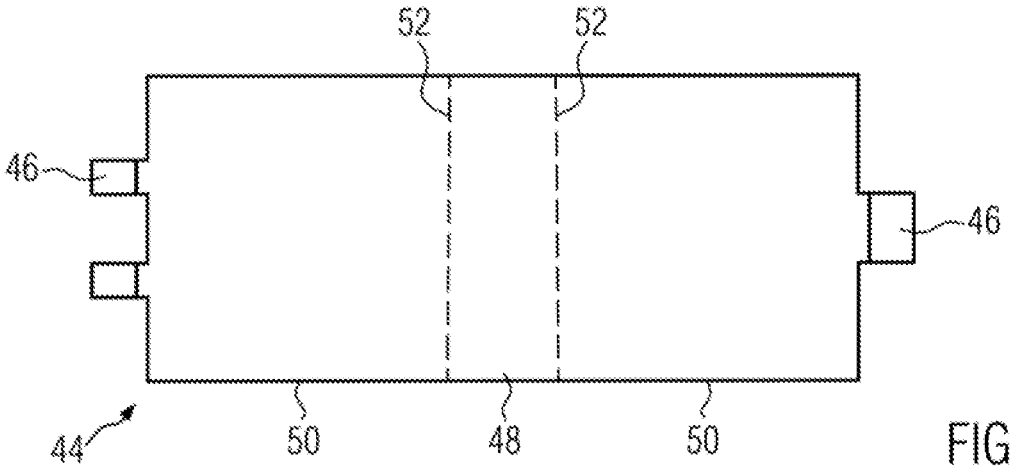
FIG. 9 shows a top view of the heater housing shown in FIG. 8.

FIG. 8 shows a side view of an alternative embodiment of a heater housing 44 which is presently configured as an extruded section made of a metal and in a top view according to FIG. 9 has a basically rectangular base area. Retaining webs 46 protrude from opposite end faces of this rectangular base area, and, as illustrated in FIG. 8, each protrude from the same surface of the section. The side view further illustrates that the section forms a base section 48 as well as two basically identical side sections 50. Integral hinges 52 are formed by reducing the material thickness of the profile between the respective sections 48, 50.

Figure 10:
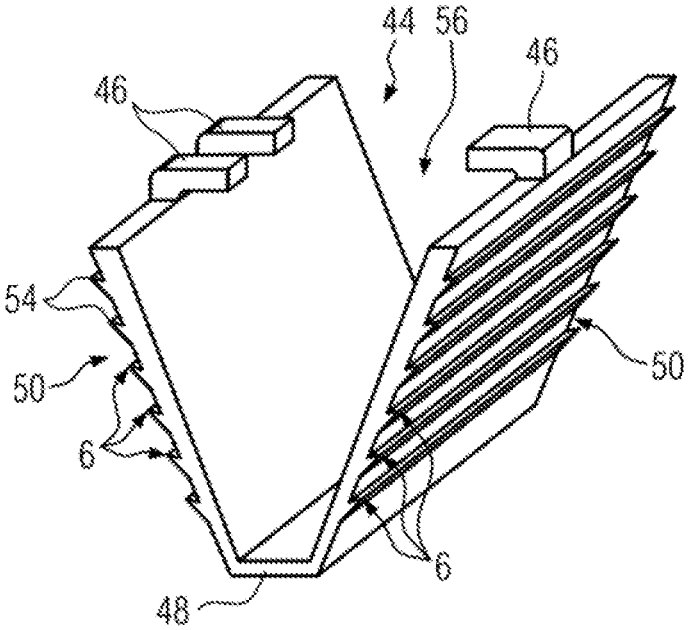
FIG. 10 shows a perspective side view of the embodiment of a heater housing shown in FIGS. 8 and 9 after the deformation.

Each of the side sections 50 has a wedge-like cross-sectional shape. A plurality of deformation projections 6 formed integrally on the section protrude from an outer surface. As illustrated in FIG. 10, the deformation projections 6 are presently designed as ribs that are formed end-to-end over the width of the extruded section. The deformation projections 6 taper sharply toward their free end identified with reference numeral 54.

Figure 11:
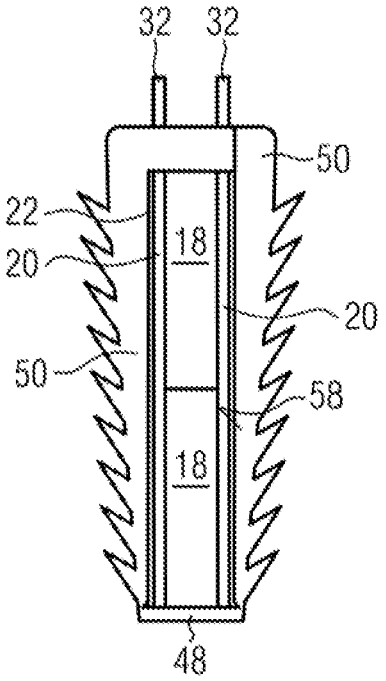
FIG. 11 shows a cross-sectional view of the heater housing according to FIGS. 8 to 10 together with the PTC element accommodated therein.

For the producing the embodiment, the extruded section according to FIGS. 8 and 9 is first drawn. Lengths are thereafter cut off as illustrated in FIG. 9. The side sections 50 are bent relative to the base section 48 around the integral hinges 52. This results in a receptacle 56 for the PTC heating element which is shown in FIG. 11 with the PTC elements 18 and the contact plates 20 abutting thereagainst on oppositely disposed main side surfaces. The main side surface of the PTC element 18 is formed by the largest side surface of this PTC element 18. The main side surface corresponds to the heat extraction surface which is identified with reference numeral 58. There is an insulating layer 22 respectively disposed on the side of the contact plate 20 opposite to the heat extraction surface. The PTC heating element 10 according to FIG. 11 is accordingly electrically separated from the heater housing 44 by the insulating layers 22. Each individual contact plate 20 forms a connection lug 32 for the electrical connection of the PTC heating element 10. The retaining webs 46 evidently protrude over the upper PTC element 18. The retaining webs 46 can be designed as engagement elements which secure the side sections 50 with the PTC heating element 10 against one another when the pressure element 44 is fitted. Even more, however, the retaining webs 46 prevent the PTC heating element 10 from migrating out of the heater housing 44 after it has been installed in the receiving pocket 24.

For assembly, the heater housing 44 is first equipped with the insulating layers 22 and the PTC heating element 10. The retaining webs 46 are then locked, whereby the pressure element 44 is closed. The unit thus preassembled is introduced into the receiving pocket 24. The deformation webs 6 deform in this process. Due to their sharply tapering ends 54, the deformation webs 6 in the installed position claw into the inner surface 26 of the receiving pocket 24, so that the heater casing 44 together with the PTC heating element 10 is permanently held securely in the installed position within the receiving pocket 24. In one variant, the heater housing 44 can also be formed having several parts. For example, an extruded section can define the wedge-shaped configuration which corresponds substantially to the geometry of the receiving pocket 24. A sheet metal strip 4, which has been described with reference to FIGS. 1-6, can be abutted on the outer side against this extruded section. Deformation projections 6 can there protrude from the sheet metal strip 4 on both sides in order to interact, firstly, with the inner surface 26 of the receiving pocket and, secondly, with the outer surface of the heater housing 44.

Figure 12:
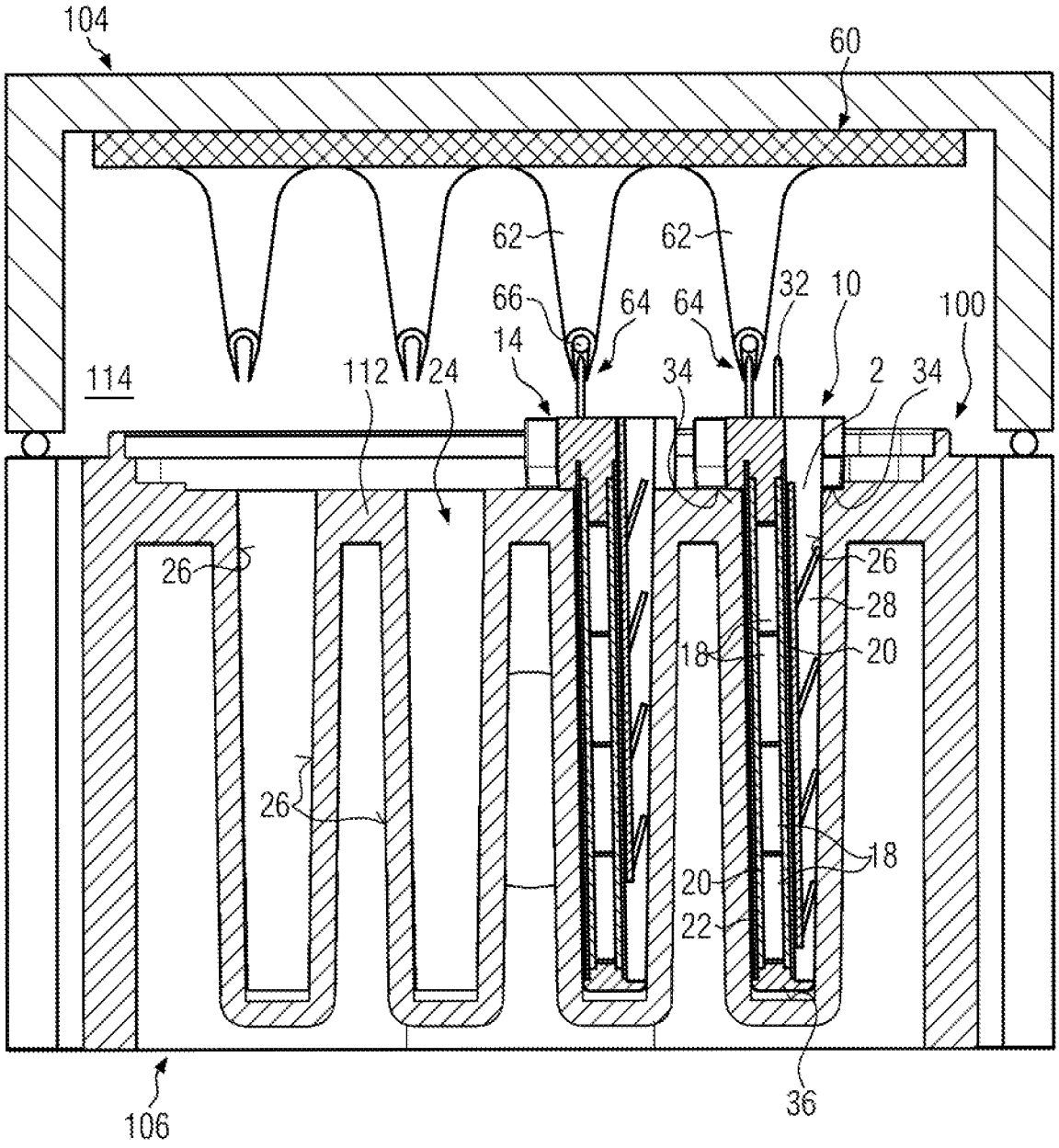
FIG. 12 shows an illustration according to FIG. 6 for a further embodiment of the present invention.

FIG. 12 shows an alternative embodiment based on the illustration according to FIG. 6. Identical components are marked with the same reference symbols.

The embodiment according to FIG. 12 shows the housing 100 covered with a housing cover 104 which forms a cover element of the invention. This housing cover 104 seals the connection chamber 114 and can have plug contacts for introducing the power current and/or for control signals of a control device provided in the connection chamber 114. The housing cover 104 carries a holding element 60 manufactured from plastic material from which holding webs 62 protrude. The holding webs 62 are each associated with a connection lug 32. A female plug element identified with reference numeral 64 is pushed onto the connection lug 32 and connected to a connecting cable, the wire of which is identified with reference numeral 66. The holding web 62 abuts against the free end of this female plug element 64. It has a U-shaped receptacle that engages around the female plug element 64 in the region of the wire 66. In this way, firstly, the electrical plug connection between the connection lug 32 and the female plug element 64 is secured. Secondly, the holding web 62 presses indirectly against the connection lug 32, as a result of which the heater housing 12 and therefore the PTC heating element 10 are secured in position in the receiving pocket 24. The U-shaped receptacle can be formed to be funnel-shaped at its open end.

Figure 13:
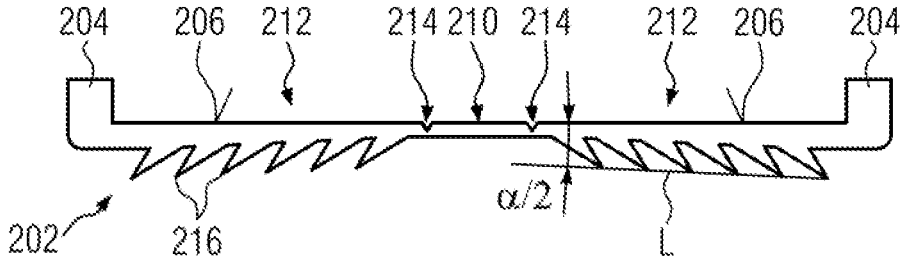
FIG. 13 shows a side view of an embodiment of a pressure element for realizing an embodiment of the present invention.

FIG. 13 shows a side view of a pressure element 202 which in the present case is configured as an extruded section made of a metal and in a top view according to FIG. 2 has a basically rectangular base area. Retaining webs 204 protrude from opposite end faces of this rectangular base area, and, as illustrated in FIG. 13, each protrude from the same surface of the profile which is a boundary surface 206 of a receptacle identified with reference numeral 208 (cf. FIG. 3). The side view further illustrates that the section forms a base section 210 as well as two basically identical side sections 212. Integral hinges 214 are formed by reducing the material thickness of the profile between the respective sections 210, 212.

Figure 15:
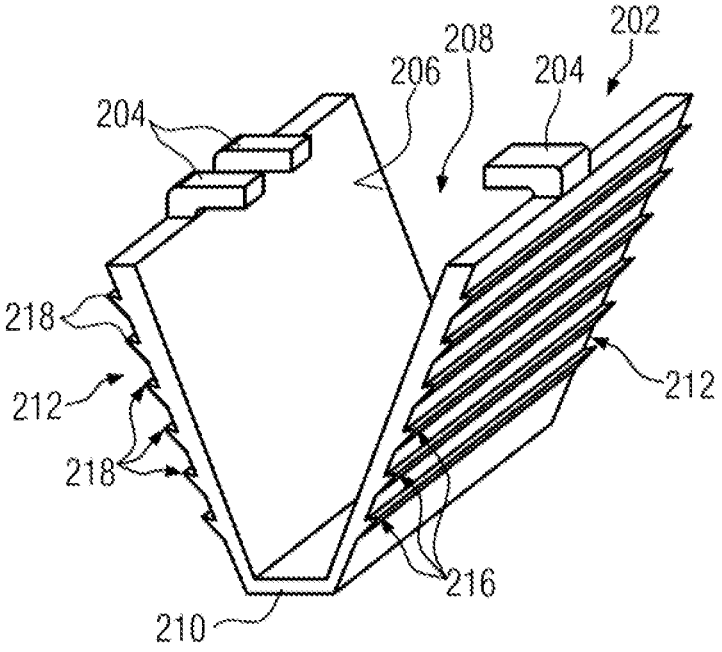
FIG. 15 shows a perspective side view of the embodiment of a pressure element shown in FIGS. 13 and 14 after the deformation.

Each of the side sections 212 has a wedge-like cross-sectional shape. A plurality of webs 216 formed integrally on the section protrude from an outer surface. As illustrated in FIG. 15, the webs 216 are presently designed as ribs that are formed end-to-end over the width of the extruded section. The webs 16 taper sharply toward their free end identified with reference numeral 218.

Figure 14:
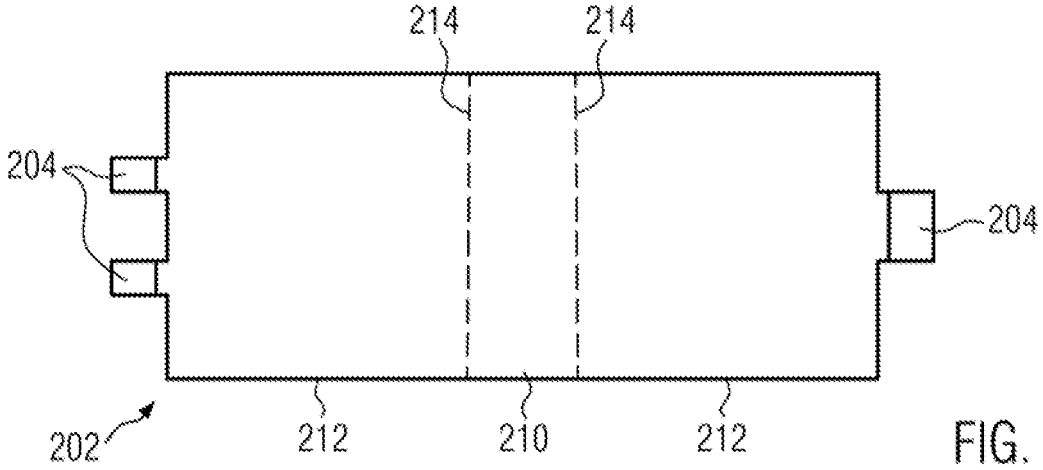
FIG. 14 shows a top view of the pressure element shown in FIG. 13.
Figure 16:
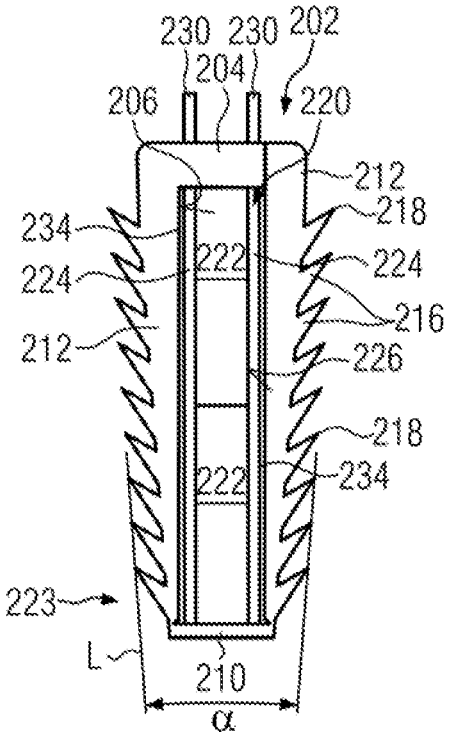
FIG. 16 shows a cross-sectional view of the pressure element according to FIGS. 13 to 15, together with the PTC element accommodated therein

For the producing the embodiment, the extruded section according to FIGS. 13 and 14 is first drawn. Lengths are thereafter cut off as illustrated in FIG. 14. The side sections 212 are bent relative to the base section 10 around the integral hinges 214. This results in the receptacle 208 for a PTC heating element 220 which is shown in FIG. 16 with the PTC elements 222 and the contact plates 224 abutting thereagainst on oppositely disposed main side surfaces. The main side surface of the PTC element 222 is formed by the largest side surface of this PTC element 222. The main side surface corresponds to the heat extraction surface which is identified with reference numeral 226. There is an insulating layer 228 respectively disposed on the side of the contact plate 224 opposite to the heat extraction surface 226. The PTC heating element 220 according to FIG. 16 is accordingly electrically separated from the pressure element 202 by the insulating layers 228. Each individual contact plate 224 forms a connecting lug 230 for the electrical connection of the PTC heating element 220. The retaining webs 204 evidently protrude over the upper PTC element 222. The retaining webs 204 can be designed as engagement elements which secure the side sections 212 against one another when the pressure element 202 is fitted with the PTC heating element 220. Even more so, however, the retaining webs 204 prevent the PTC heating element 210 from migrating out of the receptacle 208 of the pressure element 202 after it has been installed in a receiving pocket.

Figure 17:
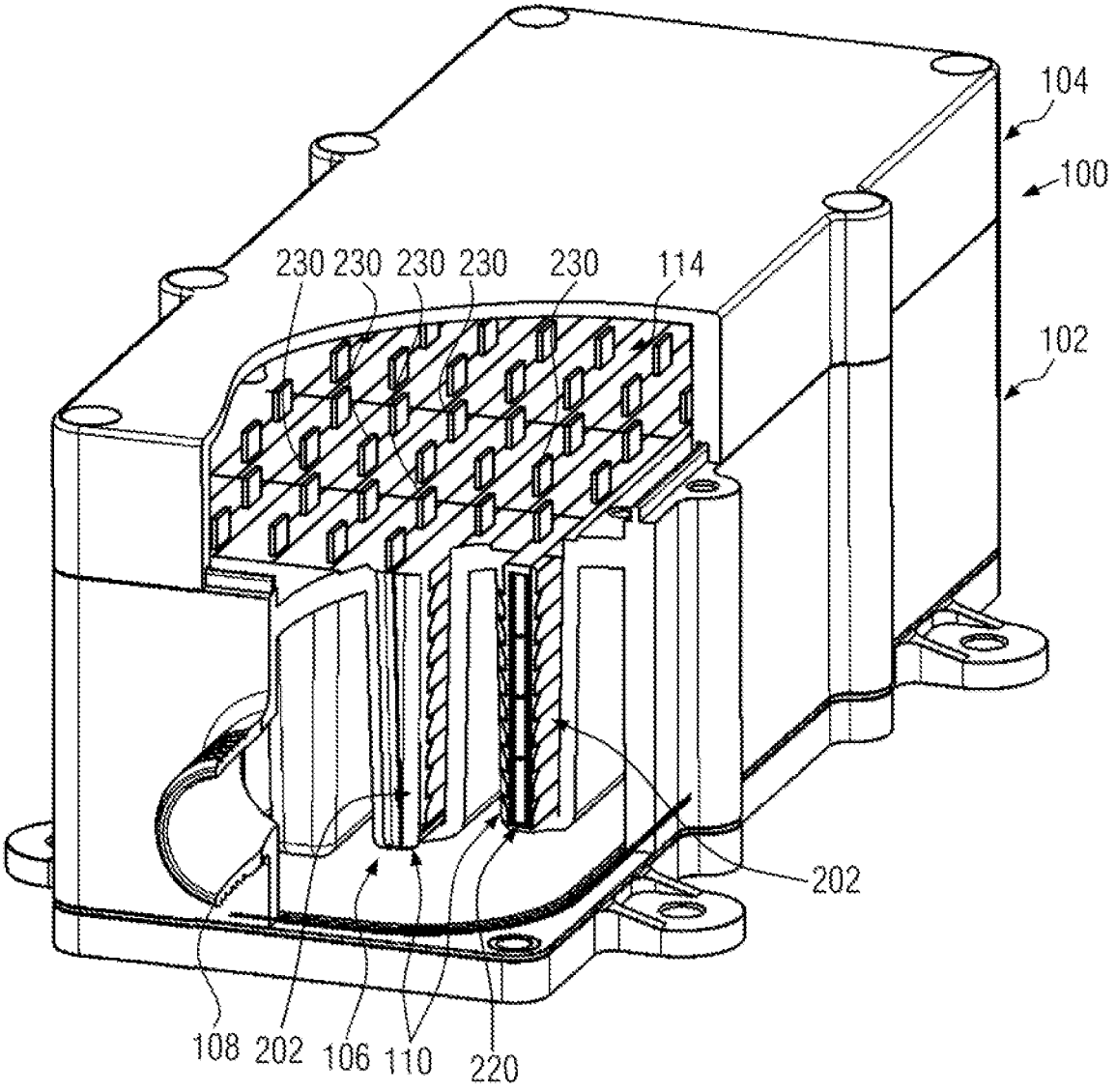
FIG. 17 shows a perspective face view of an embodiment of an electric heating device, with the pressure element partially removed.

The receiving pocket, which is dealt with in FIG. 17 et. seq., can taper conically towards its lower closed end. The pressure element has an outer contour adapted to this cross-sectional shape, which is presently defined by a connecting line L that connects the free, sharply tapering ends 218 to one another and is identified with reference symbol L in FIGS. 13 and 16. The two connecting lines L marked in FIG. 16 form an angle $\alpha$ of presently about 10°. A base body of the pressure element, from which the webs 216 protrude, already has a slightly wedge-like basic shape. The webs 216 protruding from a lower end 232 of the pressure element 202 are shorter than the webs 16 protruding in the region of an upper end 234 of the pressure element. This reinforces the wedge shape predetermined by the base body.

In the assembled state, at least the boundary surfaces 206 extend parallel to one another and abut in a planar manner against the insulating layers.

The assembly of the pressure element 202 shall be explained below with reference to FIGS. 17 and 18. They show an embodiment of an electric heating device with a housing 100 having a housing base 102 and a housing cover 104. The housing base 102 comprises a circulation chamber 106 which is connected via ports, of which only one port 108 is shown in FIG. 17, to a line for a liquid fluid to be heated. The electric heating device is, in particular, an electric heating device in a motor vehicle.

The housing base 102 forms a partition wall 112 that separates the circulation chamber 106 from a connection chamber 114.

The circulation chamber 106 is penetrated by several heating ribs 110 extending in the longitudinal direction of the housing base 102 and in a cross-sectional view having a substantially U-like cross-sectional shape and are circumferentially enclosed with respect to the circulation chamber 106. These heating ribs 110 form receiving pocket 116

In the embodiment shown, the electric heating device has adjacently disposed pockets which extend substantially over the entire length of the housing base 102. The receiving pockets 116 are considerably longer than the pressure elements 202. In the longitudinal direction of the receiving pocket 116, several pressure elements 202 fit one behind the other into the receiving pocket 116 (cf. FIG. 5). The receiving pockets 116 on their longitudinal sides form oppositely disposed inner surfaces 118.

The connection lugs 230 are exposed in the connection chamber and are connected in an electrically conductive manner to the contact plates 116, which are presently formed integrally thereon. In the embodiment shown in FIGS. 17 and 18, two connecting lugs 232 are provided for each PTC heating element 210 for energizing the PTC elements 218 with different polarities.

For the assembly, the pressure element 2 is first fitted the insulating layers 22, the contact plates 224, and the PTC elements 222. For this purpose, these layers are introduced into the funnel-shaped receptacle 208 which has not yet been completely closed and is shaped approximately as shown in FIG. 15. The retaining webs 204 are then locked, whereby the pressure element 202 is closed. The unit thus preassembled is introduced into the receiving pocket 116. The webs 216 deform in this process. Due to their sharply tapering ends 218, the webs 206 in the installed position grip the inner surface 118 of the receiving pocket 116, so that the pressure element 202 together with the PTC heating element 220 is permanently held securely in the installed position within the receiving pocket 116.

Figure 19:
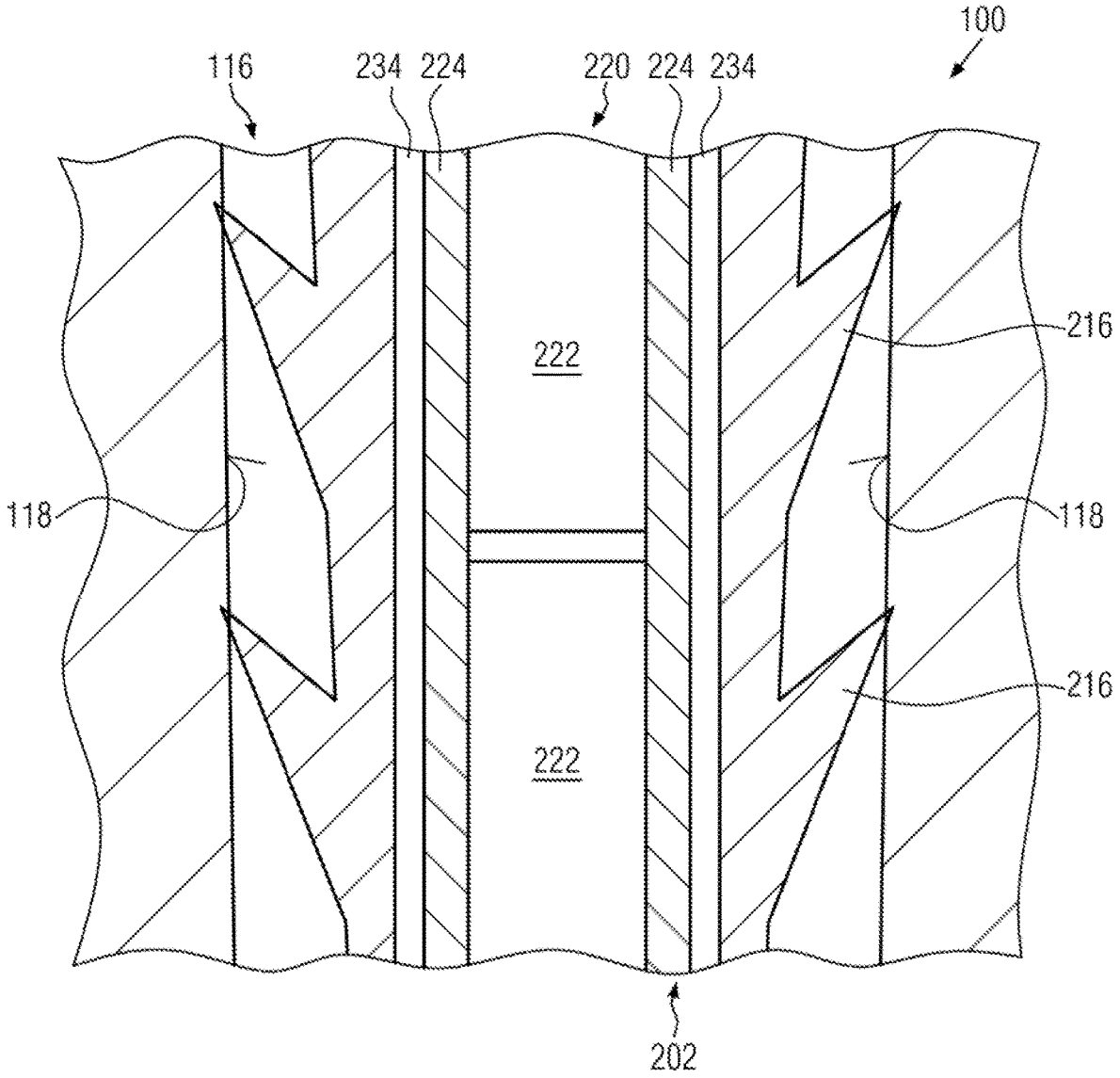
FIG. 19 shows the detail of FIG. 18 in an enlarged view.

FIG. 19 illustrates how the webs 216 grip into the inner surface 118 of the receiving pocket 116. This results in a positive-fit connection between the pressure element 202 and the metallic housing 100. The pressure element 202 is then possibly connected to ground which can be formed by the housing 100. A possible failure of the insulating layer 228 can then be determined by way of a ground monitor, which can be significant for high-voltage applications of the invention e.g. in the field of electromobility.

Figure 18:
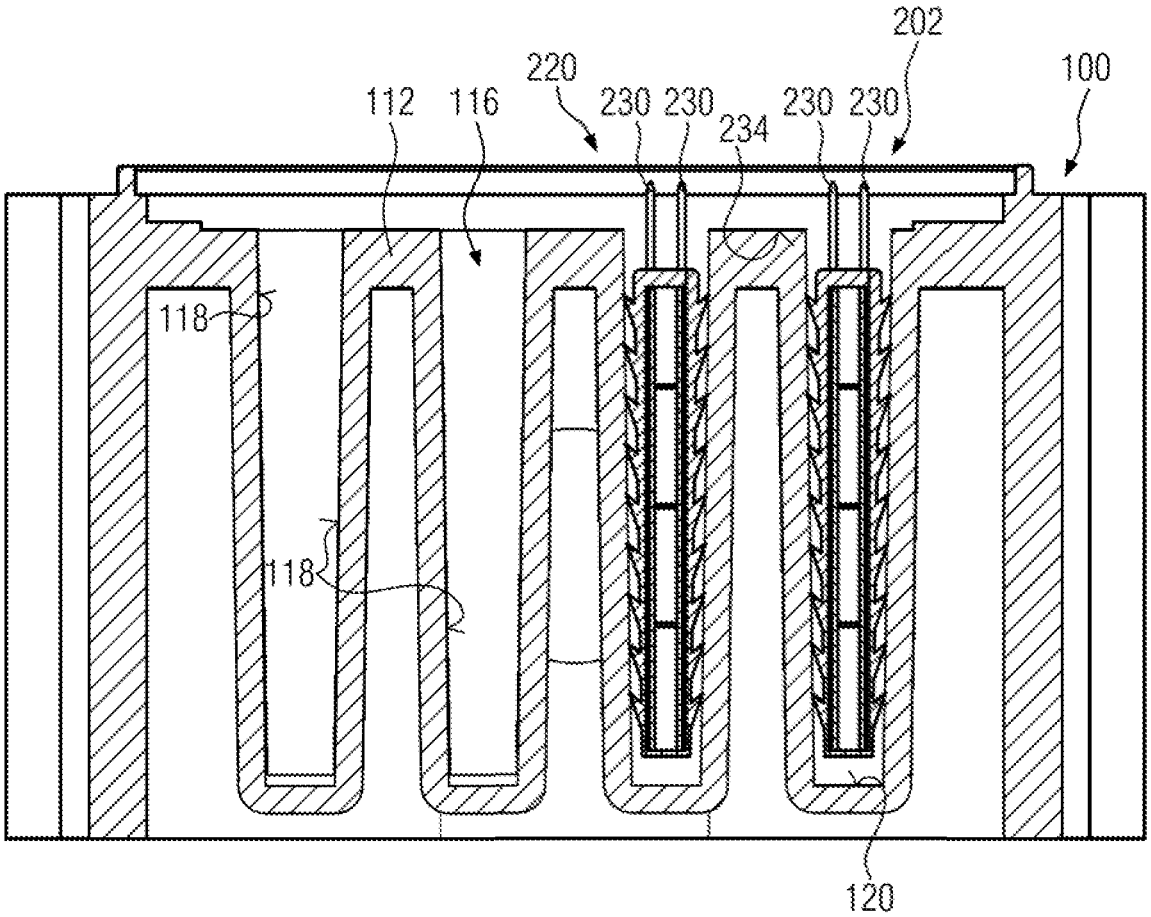
FIG. 18 shows a cross-sectional view of the embodiment shown in FIG. 17

FIGS. 18 and 19 in particular illustrate that the webs 216 provided at a lower end of the receiving pocket 116 are shorter than the webs provided at the opposite end opening toward the connection chamber 114. Corresponding to the wedge shape of the receiving pocket 116, the pressure element 202 with its outer contour assumes a wedge shape, whereas the layers of the PTC heating element have a parallel orientation relative to one another and to the boundary surfaces 206 of the pressure element 202. The webs 216 are provided inclined toward the upper end of the receiving pocket and accordingly toward the inlet opening provided there which opens into the connection chamber 114. This results in a positive-fit connection of the webs 16, which taper sharply at the front, to the inner surface 118. The pressure element then holds the heat extraction surfaces 226 of the PTC element 222, with the interposition of the associated contact plate 224 and the associated insulating layer 228, against the inner surface 118 of the receiving pocket 116.

We claim:

1. An electric heating device comprising:

a housing having a partition wall which separates a connection chamber from a heating chamber for dissipating heat and from which at least one receiving pocket, protruding into the heating chamber as a heating rib protrudes, a PTC heating element accommodated in the housing, the PTC heating element including at least one PTC element and conductor tracks for energizing the PTC element with different polarities, the conductor tracks being electrically conductively connected to the PTC element and being electrically connected in the connection chamber; and a pressure element accommodated in the housing, wherein the pressure element holds heat extraction surfaces of the PTC element abutted against oppositely disposed inner surfaces of the receiving pocket; and at least one web which acts in at least one of a positive-fit or a force-fit manner on the pressure element for retaining the PTC heating element in the receiving pocket.

2. The electric heating device according to claim 1, wherein the web acts in a positive-fit and a force-fit manner on the pressure element.

3. The electric heating device according to claim 1, wherein the web is provided in at least one of the receiving pocket and in the connection chamber.

4. The electric heating device according to claim 3, wherein the web is provided in the connection chamber.

5. The electric heating device according to claim 3, wherein the web is provided in the receiving pocket.

6. The electric heating device according to claim 1, wherein a web provided in the connection chamber and interacts with at least one of a free end of the pressure element, the PTC element, the conductor track, and an insulating layer provided in the receiving pocket.

7. The electric heating device according to claim 5, wherein the web provided in the connection chamber is connected to a cover element covering the connection chamber.

8. The electric heating device according to claim 1, wherein at least one deformation projection is held under preload between at least one of the inner surfaces of the receiving pocket and an associated heat extraction surface of the PTC element.

9. The electric heating device according to claim 8, wherein the deformation projection is clamped under preload in the receiving pocket between one of the inner surfaces of the receiving pocket and the associated heat extraction surface of the PTC element and abuts against the inner surface.

10. The electric heating device according to claim 8, wherein the deformation projection is formed obliquely relative to the heat extraction surface in a direction toward an inlet opening of the connection chamber and in a direction toward the connection chamber.

11. The electric heating device according to claim 8, wherein the deformation projection comprises a tip that claws into the inner surface of the receiving pocket.

12. The electric heating device according to claim 8, wherein the deformation projections are attached to the pressure element.

13. The electric heating device according to claim 8, wherein at least one respective deformation projection is provided between each of the heat extraction surfaces and the associated inner surfaces of the receiving pocket.

14. The electric heating device according to claim 8, wherein two PTC elements are provided in the receiving pocket between which at least one deformation projection is provided.

15. The electric heating device according to claim 8, further comprising a pocket-shaped pressure element which accommodates the PTC element and at least one of the conductor tracks and which is provided with the at least one deformation projection on at least one of its outer surfaces adjoining the heat extraction surfaces.

16. The electric heating device according to claim 8, wherein the deformation projections are formed discretely and are distributed in a planar manner over the heat extraction surfaces.

17. The electric heating device according to claim 5, wherein the pressure element comprises at least one web.

18. The electric heating device according to claim 12, wherein the pressure element has a wedge-like cross-sectional shape.

19. The electric heating device according to claim 17, wherein the pressure element comprises at least one side section which is provided between one of the heat extraction surfaces and the associated inner surface and from which a plurality of webs protrude.

20. The electric heating device according to claim 18, wherein webs provided at an upper end of the receiving pocket near the connection chamber are longer than the webs provided at a lower end of the receiving pocket.

21. The electric heating device according to claim 20, wherein the webs are clamped under preload in the receiving pocket between the inner surface of the receiving pocket and the associated heat extraction surface.

22. The electric heating device according to claim 21, wherein the webs are formed obliquely relative to the heat extraction surface and inclined in the direction toward the connection chamber.

23. The electric heating device according to claim 17, wherein the webs are formed integrally with the pressure element.

24. The electric heating device according to claim 17, wherein the pressure element is an extruded section integrally forming the oppositely disposed side sections and a base section connecting them.

25. A method for the manufacture of an electric heating device comprising a housing having a partition wall which separates a connection chamber from a heating chamber for dissipating heat and from which at least one receiving pocket, protruding into the heating chamber as a heating rib protrudes, a PTC heating element being accommodated in the housing, the PTC heating element including at least one PTC element and conductor tracks for energizing the PTC element with different polarities, the conductor paths being electrically conductively connected to the PTC element and which being electrically connected in the connection chamber, and a pressure element accommodated in the housing and holding heat extraction surfaces of the PTC element abutted against oppositely disposed inner surfaces of the receiving pocket, the method comprising:

introducing the PTC heating element into the receiving pocket; then introducing a pressure element into the receiving pocket for heat-conductive abutment of the heat extraction surfaces of the PTC element against the oppositely disposed inner surfaces of the receiving pocket and then, at least one of 1) deforming deformation projections so as to be distributed in a planar manner over the heat extraction surfaces, and 2), when the connection chamber is closed with a housing cover, providing a holding web on the housing cove in abutment against the PTC heating element.

* * * * *